US005099916A

United States Patent [19]

Vollhardt

[11] Patent Number: 5,099,916

[45] Date of Patent: Mar. 31, 1992

[54] COOLER FOR PARTICLE-LADEN GASES

[75] Inventor: Frohmut Vollhardt, Oberhausen, Fed. Rep. of Germany

[73] Assignee: MAN Gutehoffnungshütte AG, Oberhausen, Fed. Rep. of Germany

[21] Appl. No.: 651,281

[22] Filed: Feb. 5, 1991

[30] Foreign Application Priority Data

Mar. 12, 1990 [DE] Fed. Rep. of Germany ..... 4007754

[51] Int. Cl.[5] ..... F28D 7/02; F22B 1/02

[52] U.S. Cl. ..... 165/163; 165/162; 122/7 R

[58] Field of Search ..... 165/157, 162, 163, 160; 122/7 R, 32

[56] References Cited

U.S. PATENT DOCUMENTS

| | | | |
|---|---|---|---|
| 3,690,374 | 9/1972 | Vollhardt | 165/157 |
| 3,712,371 | 1/1973 | Ter Haar et al. | 165/163 |
| 3,915,224 | 10/1975 | Richter et al. | 165/163 |
| 4,029,054 | 6/1977 | Schuurman | 122/7 R |
| 4,445,463 | 5/1984 | Casper et al. | 122/7 R |
| 4,462,339 | 7/1984 | Jahnke et al. | 165/163 |
| 4,509,463 | 4/1985 | Vollhardt et al. | 122/32 |
| 4,535,727 | 8/1985 | Ziegler | 122/32 |
| 4,552,211 | 11/1985 | Weber | 165/163 |
| 4,721,065 | 1/1988 | Mohrenstecher et al. | 122/32 |
| 4,727,933 | 3/1988 | Hell et al. | 165/162 |

*Primary Examiner*—John Rivell
*Assistant Examiner*—L. R. Leo
*Attorney, Agent, or Firm*—Max Fogiel

[57] ABSTRACT

A cooler for particle-laden gases in a coal-gasification plant, with an upright nest of hot-gas tubes that coil around the cooler's longitudinal axis inside its jacket and with a pipe for supplying a coolant inside the nest of tubes. The cooler has a ceramic-lined or liquid-cooled distributing head (1) with a central gas intake (2) at the top and with several diffusor-like gas outlets (3) at the bottom that open into the nest (4) of tubes and several gas outlets (5) below the nest. The hot-gas tubes are suspended from the coolant-supply pipe (v) on claws (7). The pipe has at least one intake (8) for the descending coolant and rests on a support (9) on the base (11) of the cooler or on supports (10) against the inner surface of the cooler. The mixture of steam and water ascending among the tubes is extracted through at least one outlet (14) on the jacket (12) of the cooler.

8 Claims, 2 Drawing Sheets

COOLER FOR PARTICLE-LADEN GASES

BACKGROUND OF THE INVENTION

The invention concerns a cooler for particle-laden gases in a coal-gasification plant, with an upright nest of hot-gas tubes that coil around the cooler's longitudinal axis inside its jacket and with a pipe for supplying a coolant inside the nest of tubes.

A cooler for boiler cooling cracked or synthetic gas is known from German Patent 1 918 171. Its nest of hot-gas tubes is separated into an inner, upright section and an outer section by a partition immediately adjacent to a tank of water. The inner section of the nest communicates with the hot-gas intake. The tubes in the inner nest are arrayed in a circle. At the center of the circle is a supply pipe that is open at the bottom. Between the partition and the outer section of the nest is a channeling apron, which is also open at the bottom.

To eliminate any stagnation that might induce thermal shock in the highly stressed inner section of tubes, the boiling water is kept in circulation by gravity in this gas cooler. Prescribed circulation conditions must also be maintained in the less stressed outer section of the nest. The top of the cooler disclosed in German Patent 1 918 171 is a steam collector and its bottom merges into a water tank. The gas intake communicates with the water tank.

The gas cooler disclosed in German Patent 1 918 171 is not appropriate for the high-pressure gasification of coal because the gases that leave that process have a high percentage of ash, which can rapidly deteriorate the hot-gas tubes. The tubes deteriorate because the gases flow through the state-of-the-art cooler against the force of gravity, and any particles in the gas will drop freely and can be detrimental to the tube.

SUMMARY OF THE INVENTION

The object of the invention is to improve a cooler for particle-laden gases in a coal-gasification plant to the extent that any solids suspended in the gases are extensively prevented from precipitating and that the cooler can be operated for much longer than state-of-the-art coolers before it must be turned off to clean out the hot-gas tubes.

The particle-laden gases enter the cooler in accordance with the present invention at a temperature cf approximately 1000° C. They fall freely through the nest of hot-gas tubes from top to bottom. The gas is distributed through a ceramic-lined or liquid-cooled head with outlets that open into the nests of tubes. The outlets function like a diffusor and accordingly accelerate the gases.

The coolant, usually water, descends through the central supply pipe and ascends outside it and among the tubes in the nest in the form of a mixture of steam and water.

The inside diameter of the hot-gas tubes decreases discontinuously or continuously from top to bottom and accordingly accelerates the gases traveling through the nest, preventing any particles from settling in the system.

The cooled gas leaves the cooler at a temperature of approximately 300° C.

Variable chokes at the lower cooler end cf the gas outlets can be partly closed to further accelerate the gases flowing through the nest and will accordingly function as control valves. This approach exploits the resulting erosion to automatically clean the tubes. One such choke can of course also be completely closed in order to temporarily remove one or more tubes from the system, when operating at less than full capacity for example.

DESCRIPTION OF THE PREFERRED EMBODIMENTS

Figure 1:
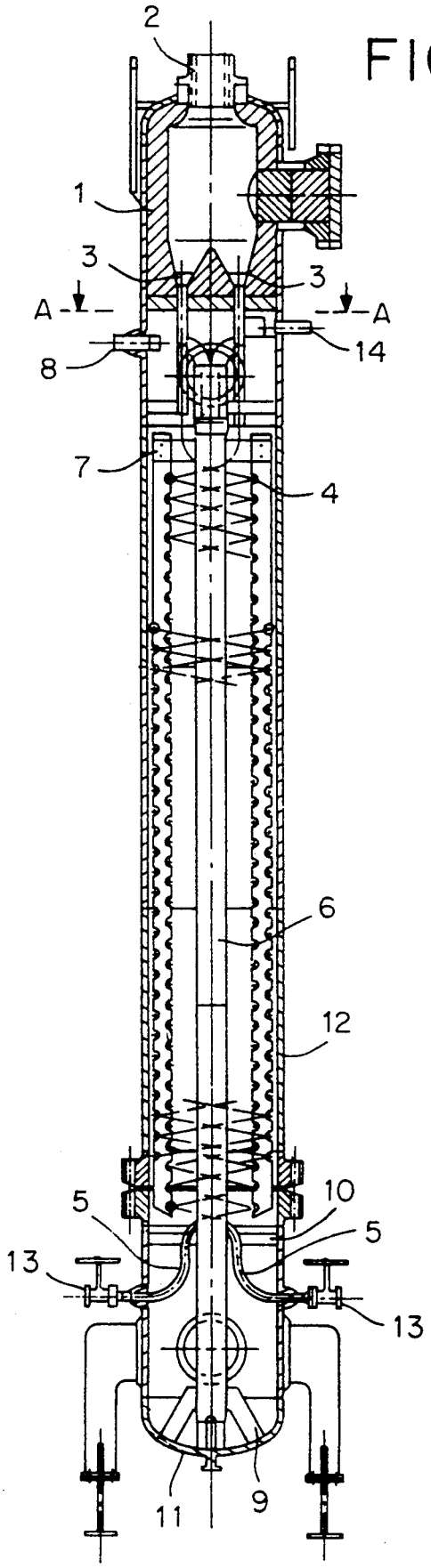
FIG. 1 is a vertical sectional view of the cooler, in accordance with the present invention.
Figure 2:
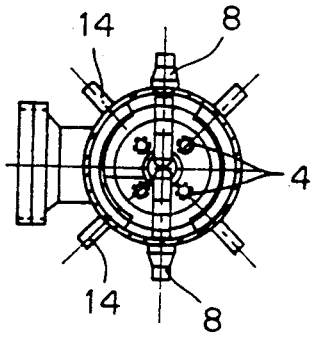
FIG. 2 is a section taken along line A—A in FIG. 1.

One embodiment of the cooler in accordance with the present invention will now be specified with reference to the drawing, wherein FIG. 1 is a vertical section and FIG. 2 is a section along the line A—A in FIG. 1.

The cooler has an upright cylindrical jacket 12. At the top is a distributing head 1. At the center of the head is an intake 2 for the particle-laden gas. The gas arrives at a temperature of approximately 1000° C. from a coal-gasification plant. Although the distributing head in the illustrated embodiment is lined with ceramic, it can also be liquid cooled.

At the bottom of distributing head 1 are several diffusor-like outlets 3 that channel the gases into a nest 4 of hot-gas tubes. Arraying the tubes in a nest makes the system more elastic, an advantage in the event of heat expansion.

Figure 3:
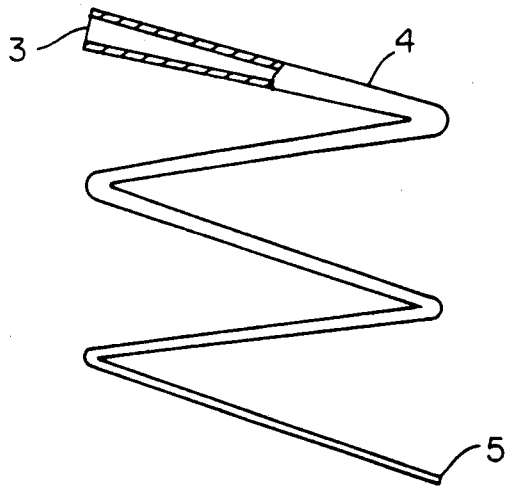
FIG. 3 is a schematic view of a hot-gas tube with decreasing diameter.

FIG. 3 illustrates how the inside diameter of the tubes decreases as its proximity to a gas outlet 5 increases. This decrease can be either incremental or continuous.

FIG. 2 illustrates four tubes 4 arrayed in a circle. A larger or smaller number of tubes can of course also be employed.

Tubes 4 are suspended by claws 7 from a central coolant-supply pipe 6. The supply pipe rests on a support 9 on the base 11 of the cooler. The pipe can also rest on supports 10 against the inner surface of jacket 12.

At the top of the cooler but below distributing head 1 are two intakes 8 for the coolant (water), in the form of risers that derive from an unillustrated steam-collecting drum, and an outlet 14 leading to four risers that forward the mixture of steam and water rising through the cooler to the steam-collecting drum.

At the bottom of the cooler and at the surface of jacket 12 that faces the cooler are gas outlets 5 with variable chokes 13. The gas exits at this point at a temperature of approximately 300° C.

I claim:

1. A cooler for particle-laden gases in a coal-gasification plant comprising: a jacket along a longitudinal axis of said cooler; an upright nest of hot-gas tubes coiling around said longitudinal axis inside said jacket; a pipe for supplying a cooling medium inside said nest of tubes; a distributing head with a central gas intake at a top side of said distributing head; a first plurality of gas outlets with reducing cross-section in flow direction at a bottom side of said distributing head and opening into said nest of tubes; a second plurality of gas outlets below said nest of tubes; a plurality of claws for suspending said hot-gas tubes from said pipe supplying cooling medium; support means for supporting said pipe supplying cooling medium against an inner surface of said cooler; said pipe for supplying cooling medium having at least one intake for descending cooling medium; and at least one outlet on said jacket of said cooler for extracting therethrough a mixture of steam and water ascending among said hot-gas tubes, said hot-gas tubes conducting gas from top to bottom of said tubes so that deposits of particles in said gas on said hot-gas tubes are prevented through flow direction of the gas and free fall of the particles.

2. A cooler as defined in claim 1, wherein said hot-gas tubes have an inside diameter decreasing discontinuously from said gas intake due to said outlets.

3. A cooler as defined in claim 1, wherein said hot-gas tubes have an inside diameter decreasing continuously from said gas intake to said outlets.

4. A cooler as defined in claim 1, including throttle means for closing off said gas outlets at a cold end of said cooler.

5. A cooler as defined in claim 1, wherein said distributing head is ceramic-lined.

6. A cooler as defined in claim 1, wherein said distributing head is liquid-cooled.

7. A cooler for particle-laden gases in a coal-gasification plant comprising: a jacket along a longitudinal axis of said cooler; an upright nest of hot-gas tubes coiling around said longitudinal axis inside said jacket; a pipe for supplying a cooling medium inside said nest of tubes; a distributing head with a central gas intake at a top side of said distributing head; a first plurality of gas outlets with reducing cross-section in flow direction at a bottom side of said distributing head and opening into said nest of tubes; a second plurality of gas outlets below said nest of tubes; a plurality of claws for suspending said hot-gas tubes from said pipe supplying cooling medium; support means for supporting said pipe supplying cooling medium against an inner surface of said cooler; said pipe for supplying cooling medium having at least one intake for descending cooling medium; and at least one outlet on said jacket of said cooler for extracting therethrough a mixture of steam and water ascending among said hot-gas tubes, said hot-gas tubes conducting gas from top to bottom of said tubes so that deposits of particles in said gas on said hot-gas tubes are prevented through flow direction of the gas and free fall of the particles; said hot-gas tubes having an inside diameter decreasing from said gas intake to said outlets; and throttle means for closing off said gas outlets at a cold end of said cooler.

8. A cooler for particle-laden gases in a coal-gasification plant comprising: a jacket along a longitudinal axis of said cooler; and upright nest of hot-gas tubes coiling around said longitudinal axis inside said jacket; a pipe for supplying a cooling medium inside said nest of tubes; a distributing head with a central gas intake at a top side of said distributing head; a first plurality of gas outlets with reducing cross-section in flow direction at a bottom side of said distributing head and opening into said nest of tubes; a second plurality of gas outlets below said nest of tubes; a plurality of claws for suspending said hot-gas tubes from said pipe supplying cooling medium; support means for supporting said pipe supplying cooling medium against an inner surface of said cooler; said pipe for supplying cooling medium having at least one intake for descending cooling medium; and at least one outlet on said jacket of said cooler for extracting therethrough a mixture of steam and water ascending among said hot-gas tubes, said hot-gas tubes conducting gas from top to bottom of said tubes so that deposits of particles in said gas on said hot-gas tubes are prevented through flow direction of the gas and free fall of the particles; said particle-laden gases entering said cooler having a temperature of substantially 1,000 degrees centigrade; said particles falling through said nest of hot-gas tubes from top to bottom, said gas being distributed by said distributing head with outlets opening into said nest of tubes, said outlets comprising diffusor means for accelerating said gases; said cooling medium comprising water descending through inside of said pipe and ascending outside said pipe among said nest of hot-gas tubes in form of a mixture of steam and water, said hot-gas tubes having an inside diameter decreasing from top to bottom for accelerating gases traveling through said nest of tubes and to prevent particles from settling in said cooler, gases leaving said cooler having a temperature of substantially 300 degrees centigrade; variable throttle means at a lower cooler end of said gas outlets for accelerating further gases flowing through said nests of hot-gas tubes and thereby clean said tubes through erosion effects.

* * * * *